US006659891B2

(12) United States Patent
Lloyd

(10) Patent No.: US 6,659,891 B2
(45) Date of Patent: Dec. 9, 2003

(54) BALL STRIKING PRACTICE DEVICE

(76) Inventor: Anthony Ivor Lloyd, 3-7231 Moffatt Rd., Richmond, B.C. (CA), V6Y 1X9

( * ) Notice: Subject to any disclaimer, the term of this patent is extended or adjusted under 35 U.S.C. 154(b) by 0 days.

(21) Appl. No.: 09/781,185

(22) Filed: Feb. 12, 2001

(65) Prior Publication Data

US 2002/0111233 A1 Aug. 15, 2002

(51) Int. Cl.[7] ..... A63B 69/00; A63B 71/00
(52) U.S. Cl. ..... 473/429; 473/417; 473/423
(58) Field of Search ..... 473/422–430, 473/417, 145, 146, 139; 273/393, 331–335; 482/83, 85, 86, 87, 90

(56) References Cited

U.S. PATENT DOCUMENTS 2,578,313 A * 12/1951 Moseley ..... 473/429
2,713,487 A * 7/1955 Jaediker ..... 473/429
3,794,320 A * 2/1974 Salmont ..... 473/429
3,876,203 A * 4/1975 Gold ..... 473/417
3,877,697 A * 4/1975 Lersch ..... 473/417
4,089,521 A * 5/1978 Berst et al. ..... 473/429
4,204,678 A * 5/1980 Weis ..... 473/423
4,508,339 A * 4/1985 Llewellyn ..... 473/429
4,508,340 A * 4/1985 Liao ..... 473/429
4,531,734 A * 7/1985 Herrick ..... 473/429
4,989,867 A * 2/1991 Herrick ..... 473/429
5,393,050 A * 2/1995 Lloyd ..... 473/429
5,467,979 A * 11/1995 Zarate ..... 473/429
5,685,542 A * 11/1997 Weis ..... 473/459

* cited by examiner

*Primary Examiner*—Paul T. Sewell
*Assistant Examiner*—Mitra Aryanpour

(57) ABSTRACT

In accordance with the present invention, the ball striking practice device comprises a base having an upper surface provided with a slot and lateral grooves, a lower surface provided with a lower lateral groove, and side walls provided with protruding lugs. A pivoting post is attached to the base and a ball is secured to a top of the pivoting post. A resillent band is positioned in a circumscribing groove of the ball and attached to the top of the pivoting post. A lateral pivoting post retaining shaft is located in the lower lateral groove for attaching the pivoting post to the base. A closed end resilient stop band is stretched across the upper surface of the base in two pairs of the lateral grooves, circumscribes the protruding lugs and secures the lateral pivoting post retaining shaft to the base. Thus, a travel of the pivoting post in the slot is predetermined.

1 Claim, 2 Drawing Sheets

BALL STRIKING PRACTICE DEVICE

FIELD OF THE INVENTION

The present invention relates to a ball striking practice device and more particularly to a device that provides a moving but secured ball to facilitate the simulation of tennis, or other play in a manner that permits solo or dual practice of the footwork, timing and strokes in a confined area. While the present invention relates in particular to such a device for striking with a racket or bat, it also envisages such a device which is adaptable to other sports and fitness activities in which a ball is struck.

BACKGROUND OF THE INVENTION

With respect to tennis, up to the present time tennis players have been limited to four methods of solo practice, which for a variety of reasons, do not meet their needs.

1. The ball machine. This is an excellent method but requires costly equipment to project the ball towards the player. A ball machine is not within the means of the average player for regular practice sessions.
2. False walls or netted frames to rebound a struck ball back to the player. The space requirement for the practice area limits availability. In addition to this the average player cannot maintain the repetitive trajectory that is essential to a consistent stroke that will build muscle memory.
3. A motionless ball sitting on an apparatus ready to be struck by a racket. This does provide practice for the basic mechanics of a tennis stroke. However ninety percent of missed strokes are related to the inability of a player to time the racket movement to coincide exactly with ball speed, so that the ball will be struck in the exact instant for an accurate ball return.
4. A ball striking device which has stabilization support arms in order to maintain stability, a ball securing device that permitted the ball to come free and pivoting post stops that could become detached.

Ball striking practice devices are well known in the prior art. Of particular reference to the present invention is U.S. Pat. No. 5,393,050, of Lloyd (Present Inventor) Issued Feb. 2, 1995 This references a pivoting post that is positioned by detachable stops, a mechanism and base which required support arms to maintain stability and metal pins that penetrated the ball to facilitate attachment. U.S. Pat. No. 2,713,487 of Jaediker issued Jul. 19, 1995 and U.S. Pat. No. 4,089,521 of Berst et el issued May 16, 1978. Both of these references are tennis practice devices comprising of base mounted pivoting posts which support tennis balls at their free ends, and in which the posts are biased to return to an initial position. Such constructions tend to be large and unwieldy, with heavily weighted bases to withstand the impact of the ball being hit and the pivoting motion of the post. As well, the positioning of the amplitude of the post remains fixed, dictated by the construction of the device.

Other references of general background interest describing and illustrating as ball striking practice devices include: U.S. Pat. No. 1,670,174 of Richards issued July, 1928, U.S. Pat. No. 2,578,313 of Mosely issued December 1951, U.S. Pat. No. 3,876,203 of Gold issued April 1975, U.S. Pat. No. 3,794,320 of Salmont issued Feb. 26, 1974, U.S. Pat. No. 3,924,853 of Schleeger issued Dec. 9, 1975, U.S. Pat. No. 4,204,678 of Weis issued May 1980 U.S. Pat. No. 4,417,730 of Weiner issued November 1983 U.S. Pat. No. 4,508,339 of Llewellyn, U.S. Pat. No. 4,508,340 of liao issued April 1985 U.S. Pat. No 4,531,734 of Herrick issued July 1985.

SUMMARY OF THE INVENTION

It is the object of the present invention to provide a lightweight; portable but stable ball striking practice device. It is a further object of the present invention to provide such a device, which will enable striking of the ball while in motion, to enhance hand-eye body co-ordination. It is further the object of the present invention to provide such a device, which will be readily adaptable to simulate game or practice conditions.

In accordance with the present invention, a ball striking practice device is provided of the type comprising an elongated base having an upper surface, a post having an end pivotally secured to the base for pivotal movement in its longitudinal direction between a first starting position and a second remote position, means for supporting a ball to be hit at the other end of the post. In accordance with the invention, an improvement in such a device is provided characterized in that a longitudinal slot is provided in the elongated base. The post is pivotally secured to the base at a location in the longitudinal slot spaced below the upper surface. Secured resilient stop means are provided on the upper surface across the slot to define the starting positions and remote positions of the post.

In a preferred embodiment the pivoting post stop means are an enclosed band that circumscribes longitudinally centered protruding lugs on both sides of the elongated base and extend across a plurality of laterally extended grooves that traverse across the upper surface of the elongated base in a predetermined location, thus providing the stop at both extremes of the pivoting posts travel. This embodiment also includes a single laterally extended groove in the lower surface of the base directly below the position of the aforementioned protruding lugs and latterly in line, the said groove to accept the pivoting post retaining shaft. It is further an improvement of the present invention that the pivoting post retaining shaft is secured in the lateral groove during operation of the practice device by the resilient stop band being positioned by the protruding lugs in a manner that requires the lateral pivoting post retaining shaft to be forced beneath the surface of the resilient stop band when entering into the groove. The edges of the lateral groove plus the circumscribing friction contact of the resilient band combine to retain the lateral shaft.

In further accordance with this invention a ball with a circumscribed groove is secured on the upper portion of the pivoting post with a resilient hose or band that is fastened to the upper curved section of the pivoting post and circumscribes the ball in a manner that permits the securing resilient hose to be positioned in the said grooves of the ball.

The device according to the present invention is of a simple lightweight construction and readily affords mass production.

A "T' ball adapter for positioning an unsecured ball above the grooved ball and a padded ball cover are envisioned additions to this invention

BRIEF DESCRIPTION OF THE DRAWINGS

These and other objects and advantages of the invention will become apparent upon reading the following detailed description and upon referring to the drawings in which.

Figure 1:
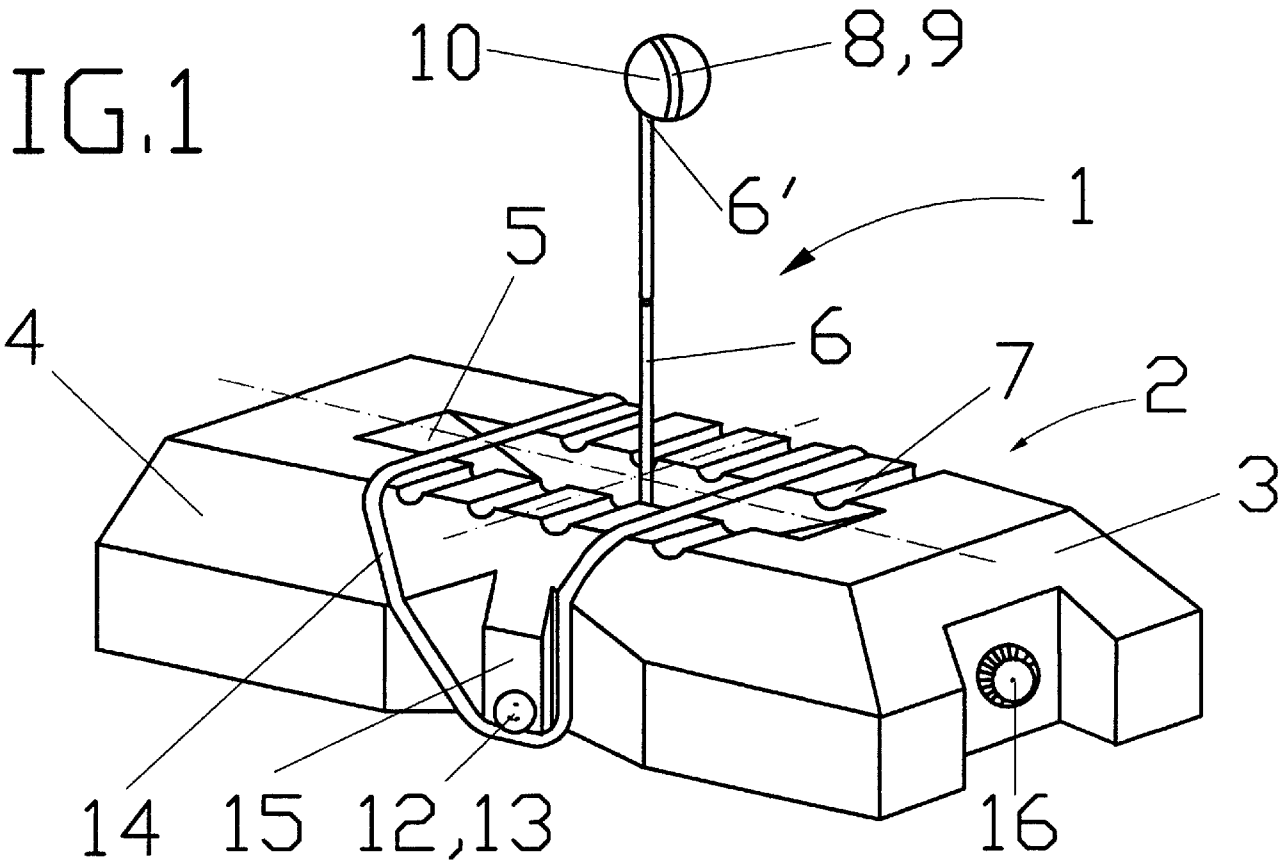
FIG. 1. Is a perspective view of a preferred embodiment of ball striking practice device in accordance with the present invention.

Section A—A Is a side view of the device of FIG. 1.

Section B—B Is an end view of the device of FIG. 1.

View C Is a top plan view of the base and lateral shaft position of the device of FIG. 1.

View D Is a view of the resilient stop band and lateral pivoting post retainer.

Figure 2:
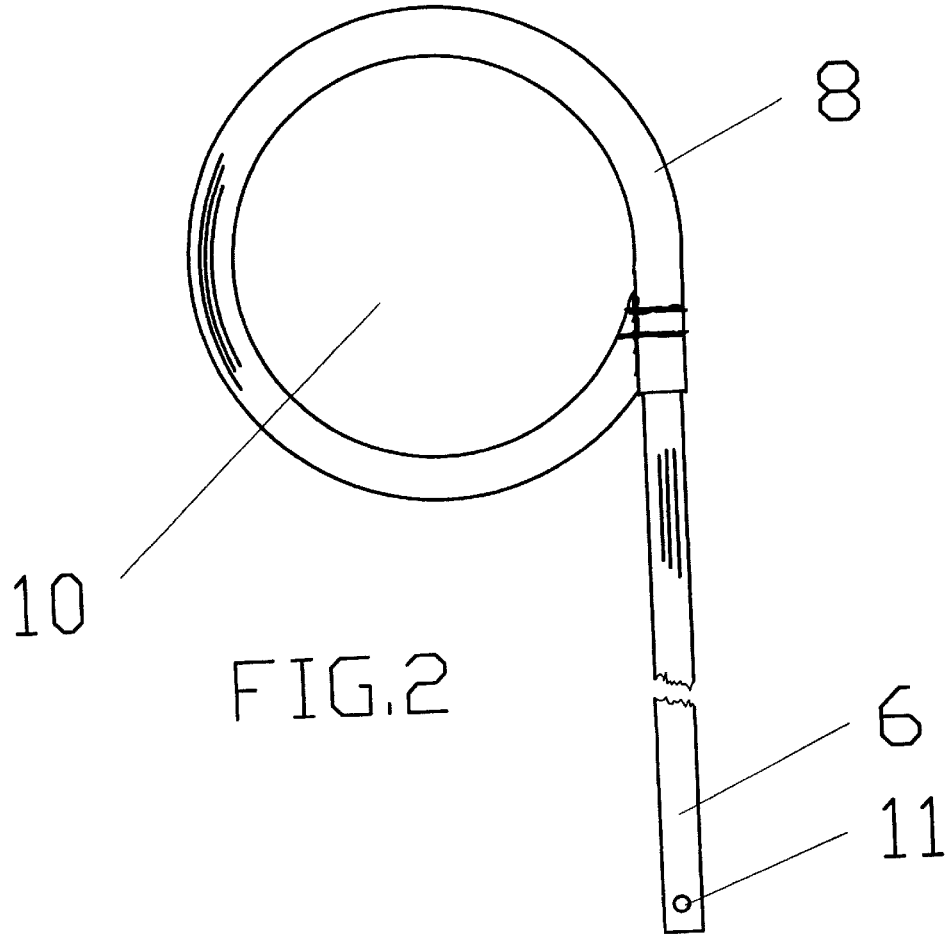

FIG. 2. Illustrates the closed end resilient stop band.

Figure 3:
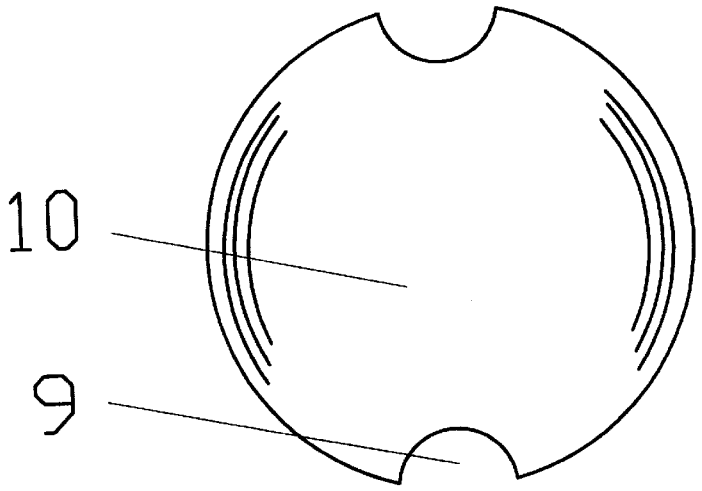

FIG. 3 Illustrates the embodiment of the ball retaining device and the lateral post retaining shaft securing point to the longitudinally pivoting post.

FIG. 4. Illustrates the grooved ball.

DETAILED DESCRIPTION OF THE PREFERRED EMBODIMENTS

In the drawings, similar features have been given similar reference numbers. Turning to FIG. 1 there is illustrated a ball striking practice device, particularly adapted to tennis, in accordance with the present invention. This ball striking practice device comprises an elongated base or frame (2) having a proximal end (3) and a remote end (4) with an elongated slot (5) centered longitudinally and laterally, extending the length of the required travel of the longitudinally pivoting post (6). The elongated base (2) upper surface has lateral grooves (7) the function of which will be described in more detail hereafter. FIG. 1. further illustrates a longitudinally pivoting post (6) of a resilient material. At the curved top of the pivoting post (6) is attached a resilient hose or band (8) the resilient hose (8) is positioned in the circumscribing groove (9) of a ball (10) the remote end of the resilient hose (8) is secured to the pivoting post (6) to form a closed loop, thus securing the grooved ball. (10)

In the lower portion of the pivoting post (6) is positioned a hole (11) to receive a pivoting post retaining shaft (12) said shaft provides an anchor point about which the longitudinally pivoting post (6) pivots.

In the lower surface of the elongated base (2) is a lateral groove (13) in a longitudinally centered position that accepts the pivoting post retaining shaft. (12) The pivoting post retaining shaft (12) is secured in the lateral groove (13) during operation of the ball striking practice device, by the closed end resilient stop band (15) being positioned by the lugs (14) in a manner that requires the lateral post retaining shaft (12) to be forced beneath the surface of the resilient stop band (15) when entering into the lateral groove (13) and the lower hole (11) in the longitudinally pivoting post (6). The edges of the lateral groove (13) combined with the circumscribing friction contact of the closed end resilient band (15) cause the lateral post retaining shaft (12) to be secured. A plurality of laterally extended grooves (7) are spaced across the upper surface of the elongated base (2) a protruding lug (14) is situated on both side walls of the elongated base (2). The resilient stop means comprises a closed end single resilient band (15) that is stretched to circumscribe the two protruding lugs (14) and traverse across the upper surface of the elongated base (2) to position across two pairs of upper lateral grooves (7) in a predetermined location.

The closed end single resilient band (15) is positioned to provide the stop at both extremes of the longitudinally pivoting post's (6) required travel.

The preferred embodiment of the elongated base (2) is a blow moulded plastic material, an end cap (16) to permit the interior to be filled with a material or fluid to add weight to the elongated base (2) is located in the proximal end (3) of the elongated base. (2)

The embodiments of the invention in which an exclusive property or privilege is claimed are defined as follows:

1. Ball striking practice device, comprising an elongated base having an upper surface provided with an elongated slot and lateral grooves, a lower surface provided with a lower lateral groove, and side walls with protruding lugs;

a longitudinally pivoting post attached to said elongated base;

a ball secured to a top of said longitudinally pivoting post, a resilient band positioned in a circumscribing groove of said ball and attached to said top of said longitudinally pivoting post;

a resilient band positioned in a circumscribing groove of said ball and attached to said top of said longitudinally pivoting post;

a lateral pivoting post retaining shaft located in said lower lateral groove for attaching said longitudinally pivoting post to said elongated base; and a closed end resilient stop band, stretched across said upper surface of said elongated base in two pairs of said lateral grooves and circumscribing said protruding lugs, secures said lateral pivoting post retaining shaft to said elongated base and predetermines a travel of said longitudinally pivoting post in said elongated slot.

* * * * *